US008143538B2

(12) United States Patent
Hong

(10) Patent No.: US 8,143,538 B2
(45) Date of Patent: Mar. 27, 2012

(54) MULTI-DIRECTIONAL OPERATING SWITCH ASSEMBLY

(75) Inventor: Wen-Jan Hong, Taoyuan (TW)

(73) Assignee: Taiwan Misaki Electronics Co, Ltd, Taoyuan, Taoyuan Hsien (TW)

( * ) Notice: Subject to any disclaimer, the term of this patent is extended or adjusted under 35 U.S.C. 154(b) by 254 days.

(21) Appl. No.: 12/687,565

(22) Filed: Jan. 14, 2010

(65) Prior Publication Data

US 2010/0294639 A1 Nov. 25, 2010

(51) Int. Cl.
*H01H 9/26* (2006.01)

(52) U.S. Cl. ..... 200/5 B

(58) Field of Classification Search ..... 200/5 A, 200/176, 5 B

See application file for complete search history.

(56) References Cited

U.S. PATENT DOCUMENTS 4,196,322 A * 4/1980 Hattori ..... 200/5 R
6,528,740 B2 * 3/2003 Miyoshi ..... 200/5 R
6,603,459 B2 * 8/2003 Matsufusa et al. ..... 345/156
7,898,440 B2 * 3/2011 Chen ..... 341/22
8,042,868 B2 * 10/2011 Sakai et al. ..... 297/217.3

* cited by examiner

*Primary Examiner* — Edwin A. Leon

*Assistant Examiner* — Vanessa Girardi

(74) *Attorney, Agent, or Firm* — Overhauser Law Offices, LLC

(57) ABSTRACT

A multi-directional operating switch assembly includes: a recessed base; first and second switches disposed in the recessed base; a slider disposed in the recessed base and having a main part and a protrusion protruding from the main part, the slider being slidable in a first direction so as to actuate the first switch; an operating lever having a slot defined by a slot-defining wall, the protrusion of the slider extending into the slot, the operating lever being movable in the first direction to drive the slider to move in the first direction, and being further movable relative to the slider in a second direction to actuate the second switch; and an urging member disposed in the slot and abutting against the protrusion and the slot-defining wall.

12 Claims, 10 Drawing Sheets

MULTI-DIRECTIONAL OPERATING SWITCH ASSEMBLY

BACKGROUND OF THE INVENTION

1. Field of the Invention

This invention relates to a multi-directional operating switch assembly, more particularly to a multi-directional operating switch assembly including an operating lever that is operable to move in a first direction to actuate a first switch and in a second direction different from the first direction to actuate a second switch.

2. Description of the Related Art

FIGS. 1 to 3 illustrate a conventional multi-directional operating switch assembly 300 that includes: a recessed base 303; a button switch 304 mounted in the recessed base 303; an urging member 305 surrounding the button switch 304; a confining member 306 supported on the urging member 305 and aligned with the button switch 304 in a vertical direction; a switch support 307 mounted on the recessed base 303 and disposed above the confining member 306; first and second switches 308, 309 mounted on the switch support 307; an operating member 310 mounted slidably on the confining member 306; a slider support 311 mounted on the switch support 307; a first actuating plate 314 mounted slidably on the slider support 311 and formed with a first elongate slot 3141 extending in a first direction; a second actuating plate 315 mounted slidably on the slider support 311, disposed above the slider support 311, and formed with an elongate second slot 3151 extending in a second direction transverse to the first direction; and a cover 302 covering a top opening of the recessed base 303. The operating member 310 has a disc 3101 and an operating rod 3102 extending from the disc 3101 through the first and second slots 3141, 3151 and the cover 302, and which is operable to move selectively in the first and second directions and a third direction transverse to the first and second directions.

In operation, when the operating member 310 is pressed to move downwardly in the third direction, the confining member 306 is pushed by the disc 3101 to press against the urging member 305 and the button switch 304 to thereby actuate the button switch 304. When the operating member 310 is moved in the second direction, the first actuating plate 314 is driven by the operating member 310 to move in the second direction to actuate the first switch 308, and when the operating member 310 is moved in the first direction, the second actuating plate 315 is driven by the operating member 310 to move in the first direction to actuate the second switch 309.

Since the confining member 306 and the urging member 305 surround the button switch 304, the confining member 306 and the urging member 305 are necessarily made large in size, which undesirably enlarges overall dimensions of the aforesaid conventional switch assembly. Moreover, the entire structure of the aforesaid conventional switch assembly is complicated.

SUMMARY OF THE INVENTION

Therefore, the object of this invention is to provide a multi-directional operating switch assembly that is capable of overcoming at least one of the aforesaid drawbacks of the prior art.

According to the present invention, a multi-directional operating switch assembly includes: a recessed base; a first switch disposed in the recessed base; a second switch disposed in the recessed base; a slider disposed slidably in the recessed base and having a main part and a protrusion protruding from the main part, the slider being slidably relative to the recessed base in a first direction so as to actuate the first switch; an operating lever having a slot defined by a slot-defining wall, the protrusion of the slider extending into the slot, the operating lever being movably supported on the main part of the slider, being movable relative to the recessed base in the first direction to drive the slider to move in the first direction, and being further movable relative to the slider in a second direction to actuate the second switch, the first and second directions crossing each other; and an urging member disposed in the slot and abutting against the protrusion of the slider and the slot-defining wall such that the urging member accumulates a restoring force when the operating lever is moved in the second direction to actuate the second switch.

BRIEF DESCRIPTION OF THE DRAWINGS

Other features and advantages of the present invention will become apparent in the following detailed description of the preferred embodiments of the invention, with reference to the accompanying drawings. In the drawings.

DETAILED DESCRIPTION OF THE PREFERRED EMBODIMENTS

Figure 1:
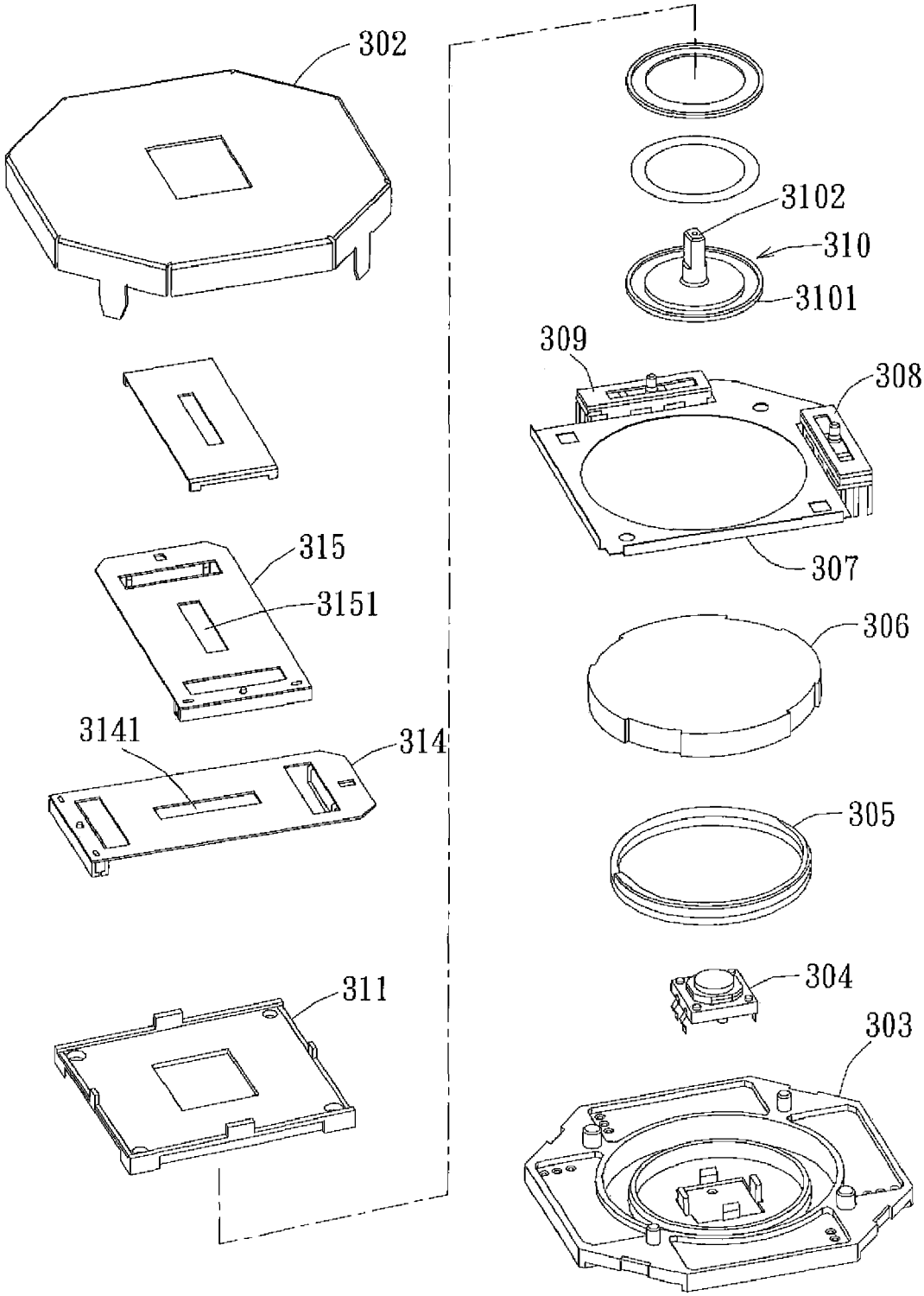
FIG. 1 PRIOR ART
FIG. 1 is an exploded perspective view of a conventional multi-directional operating switch assembly.
Figure 2:
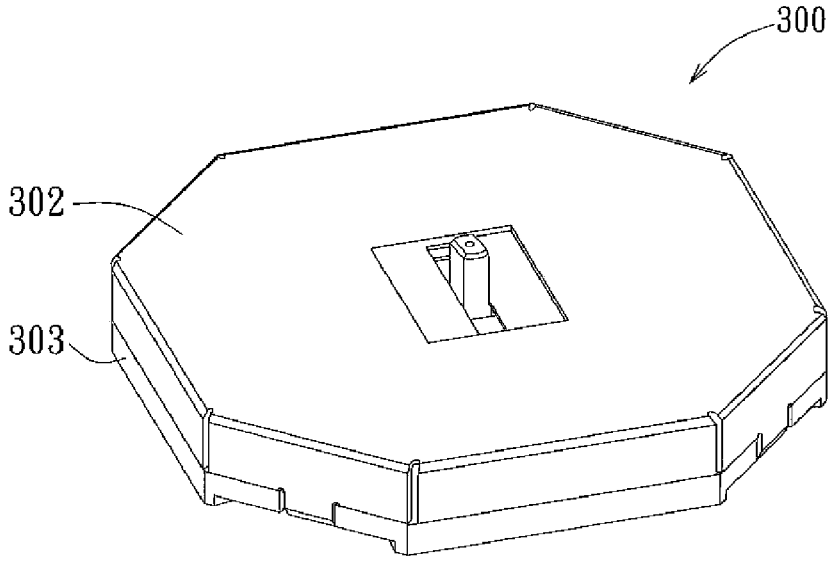
FIG. 2 PRIOR ART
FIG. 2 is an assembled perspective view of the conventional multi-directional operating switch assembly.
Figure 3:
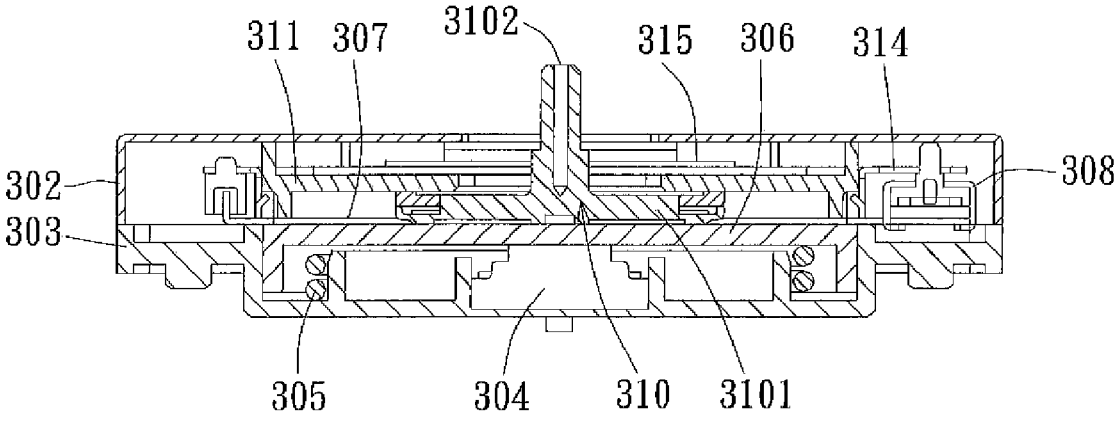
FIG. 3 PRIOR ART
FIG. 3 is a sectional view of the conventional multi-directional operating switch assembly.
Figure 4:
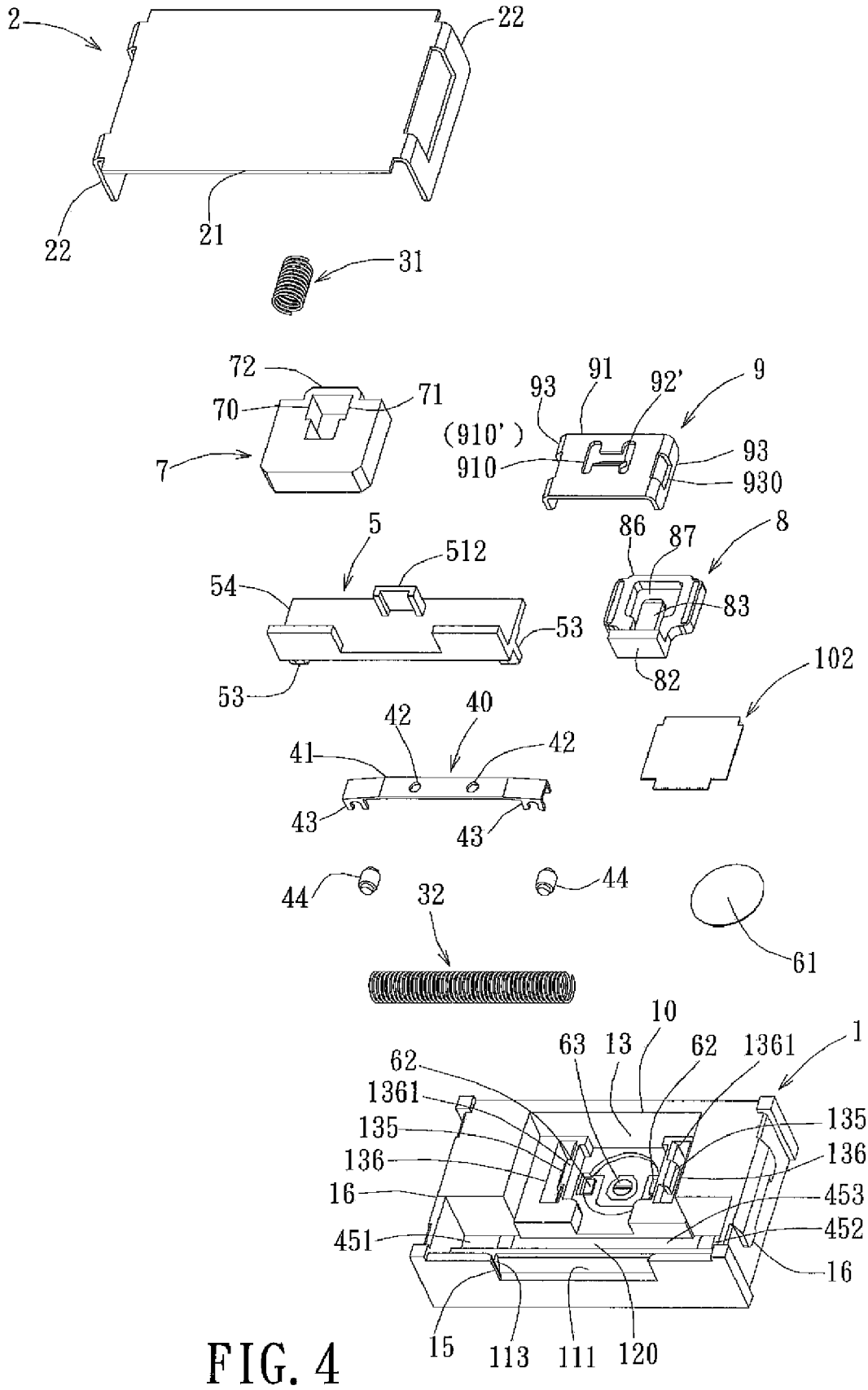
FIG. 4 is an exploded perspective view of the first preferred embodiment of a multi-directional operating switch assembly according to the present invention.
Figure 5:
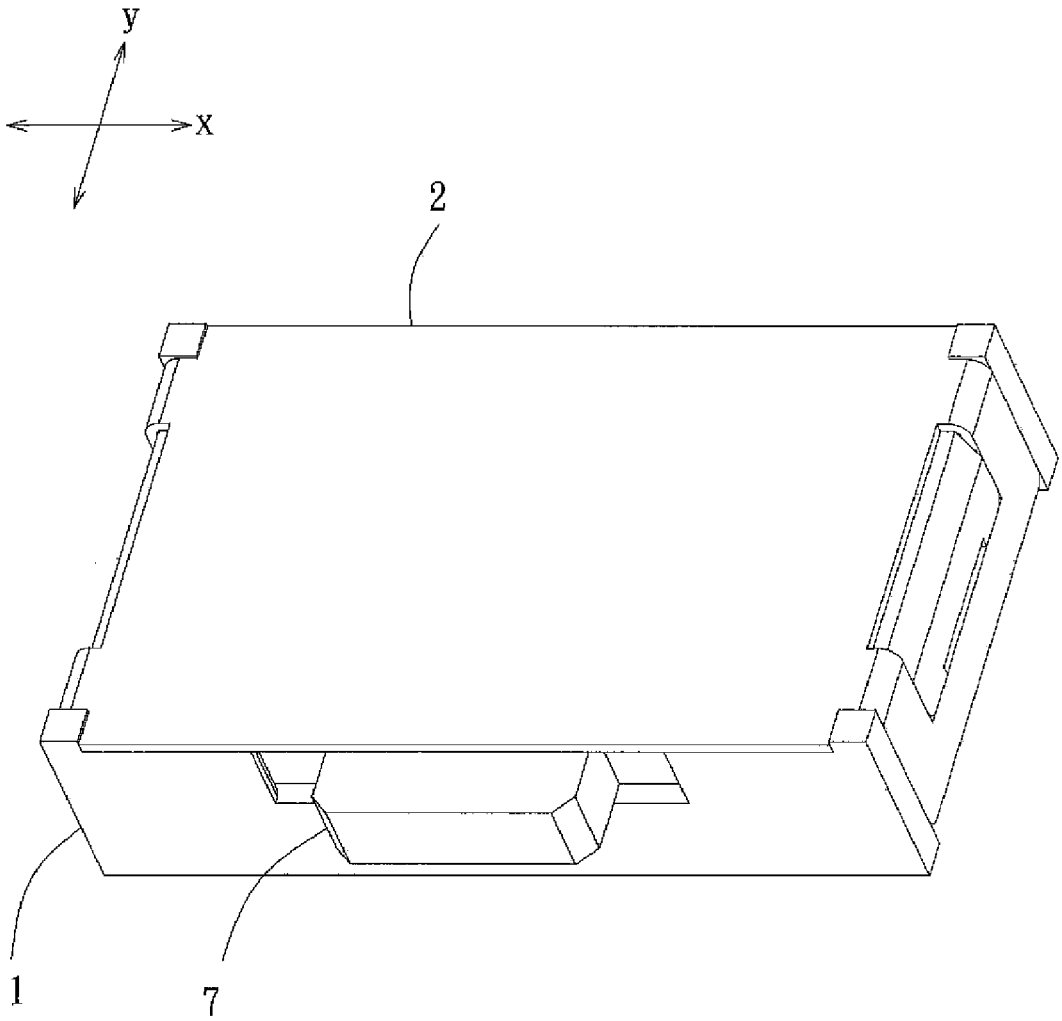
FIG. 5 is an assembled perspective view of the first preferred embodiment.
Figure 6:
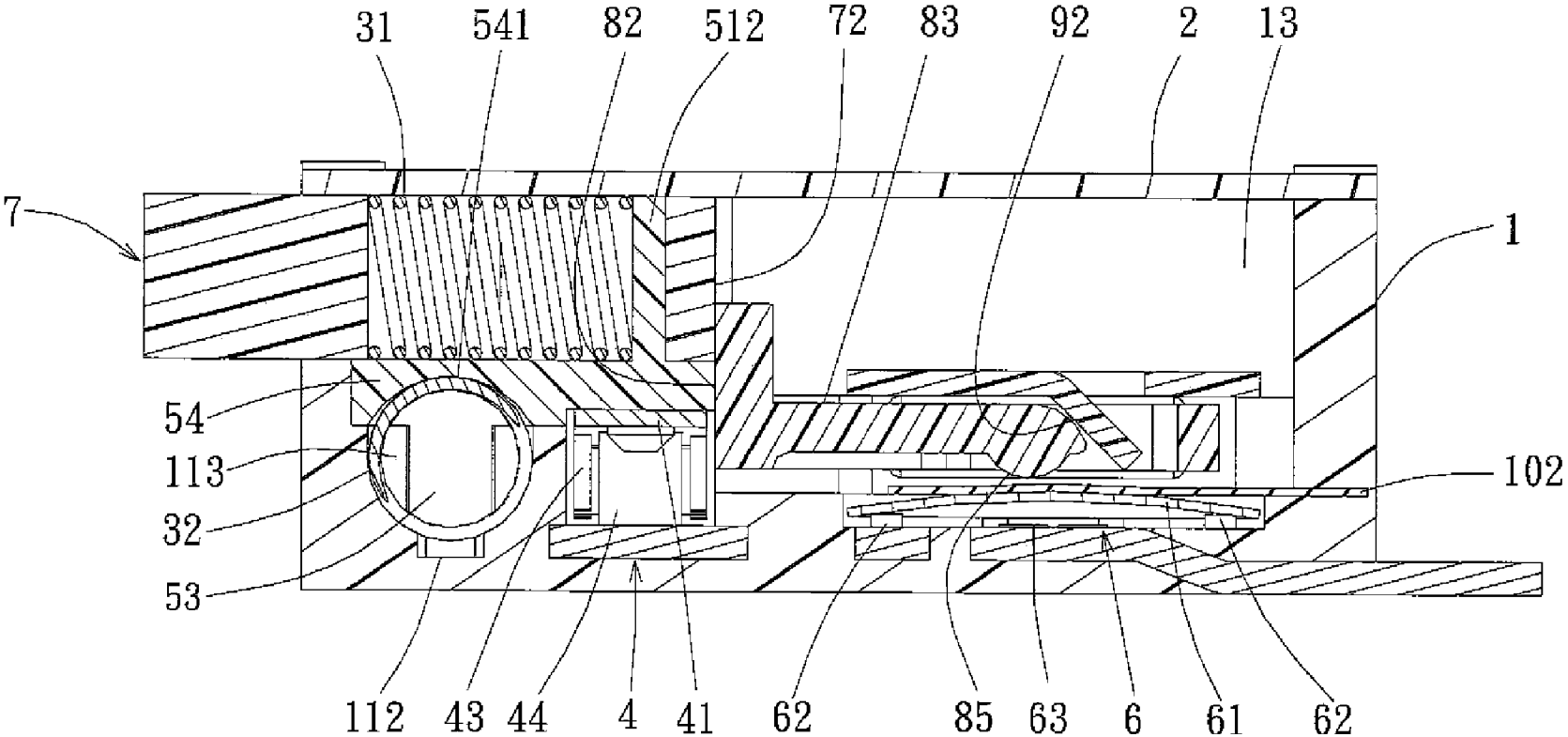
FIG. 6 is a sectional view of the first preferred embodiment.
Figure 7:
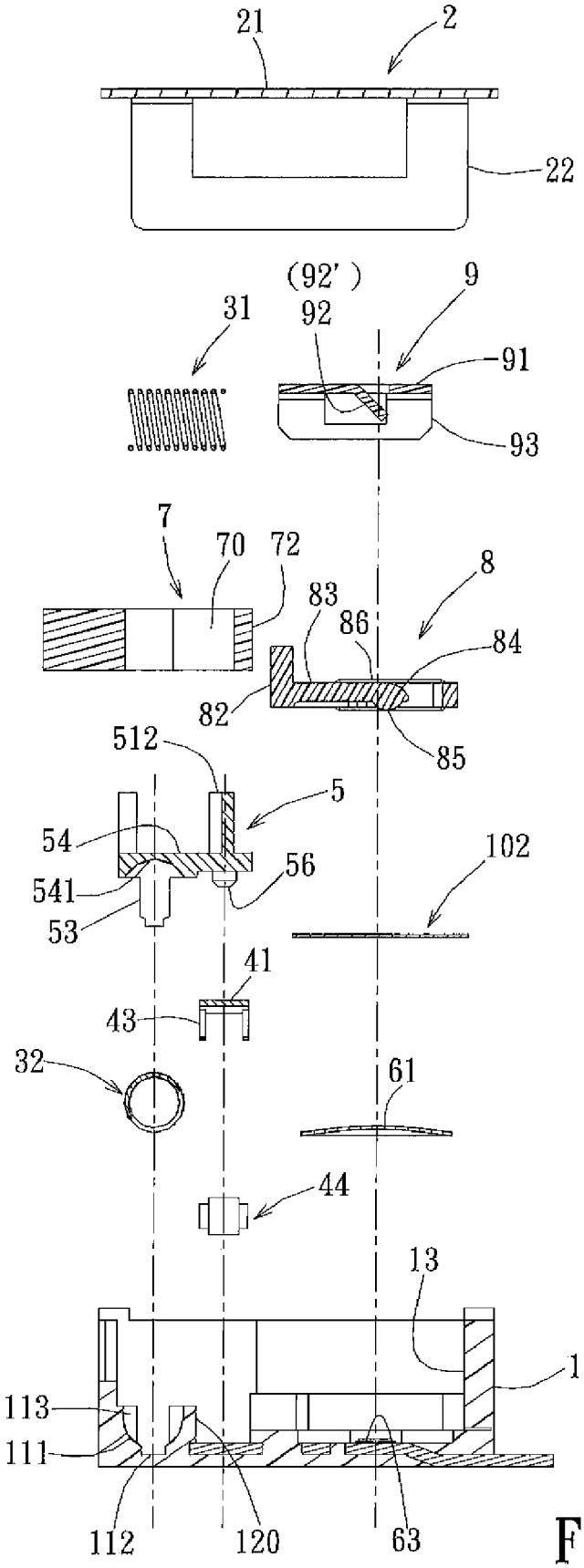
FIG. 7 is an exploded sectional view of the first preferred embodiment.

Before the present invention is described in greater detail with reference to the accompanying preferred embodiments, it should be noted herein that like elements are denoted by the same reference numerals throughout the disclosure.

FIGS. 4 to 7 illustrate the first preferred embodiment of a multi-directional operating switch assembly according to this invention.

The multi-directional operating switch assembly includes: a recessed base 1 having a top opening 10 and a side notch 15; a first switch 4 disposed in the recessed base 1; a second switch 6 disposed in the recessed base 1; a slider 5 disposed slidably in the recessed base 1 and having a flat main part 54 and a protrusion 512 protruding upwardly from the main part 54, the slider 5 being slidable relative to the recessed base 1 in a first direction (X) so as to actuate the first switch 4; an operating lever 7 having a slot 71 defined by a slot-defining wall 70, the protrusion 512 of the slider 5 extending into the slot 71, the operating lever 7 being movably supported on the main part 54 of the slider 5, extending outwardly through the side notch 15 in a second direction (Y), being movable relative to the recessed base 1 in the first direction (X) to drive the slider 5 to move in the first direction (X), and being further movable relative to the slider 5 in the second direction (Y) to actuate the second switch 6, the first and second directions (X, Y) crossing each other; a first urging member 31 disposed in the slot 71 and abutting against the protrusion 512 of the slider 5 and the slot-defining wall 70 such that the first urging member 31 accumulates a restoring force when the operating lever 7 is moved in the second direction (Y) to actuate the second switch 6; and a cover 2 covering the top opening 10 of the recessed base 1.

In this embodiment, the second switch 6 includes: two opposite conductive fixed contacts 62 secured to the recessed base 1; a conductive middle contact 63 secured to the recessed base 1 and disposed between the fixed contacts 62; a conductive flexible contact 61 convex in shape, having two opposing portions in constant contact with the fixed contacts 62, respectively, and flexible to bend toward and away from the middle contact 63; a blocking plate 9 secured to the recessed base 1 and having a slanted driving surface 92 slanted downwardly relative to the second direction (Y); and an actuating part 8 mounted movably in the recessed base 1 and having a flexible arm 83.

Figure 10:
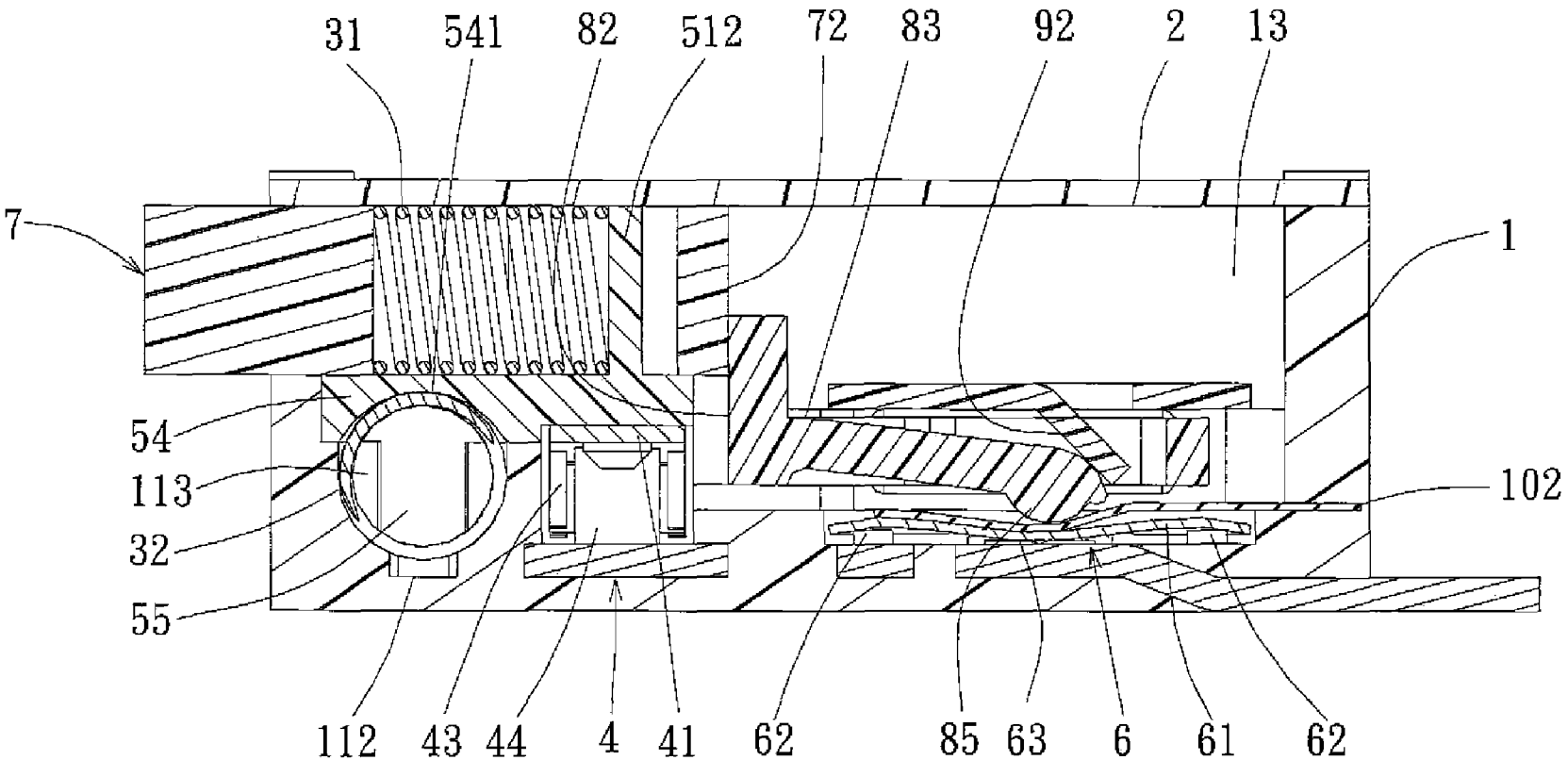
FIG. 10 is a sectional view of the first preferred embodiment to illustrate a state where an actuating part driven by an operating lever is disposed at an actuating position.

The middle contact 63 and the fixed contacts 62 are respectively connected to terminals (not shown) embedded in the recessed base 1 for external connection to a circuit (not shown). The operating lever 7 is movable in the second direction (Y) relative to the slider 5 to drive the actuating part 8 to move in the second direction (Y) from a normal position (see FIG. 6) to an actuating position (see FIG. 10). The driving surface 92 of the blocking plate 9 is configured to bend the flexible arm 83 such that the flexible arm 83 is bent to trace downwardly and inclinedly along the driving surface 92 toward the flexible contact 61 when the actuating part 8 is driven by the operating lever 7 to move in the second direction (Y) from the normal position to the actuating position. The flexible arm 83 is configured to bend the flexible contact 61 toward the middle contact 63 such that the flexible contact 61 is brought into contact with the middle contact 63 when the flexible arm 83 is bent by the driving surface 92 upon movement of the actuating part 8 in the second direction (Y) to the actuating position, thereby connecting the fixed contacts 62 to the middle contact 63 and thus actuating the second switch 6. The flexible contact 61 returns resiliently to its normal convex shape when the actuating part 8 and the operating lever 7 return to their original position (i.e., the normal position) by the restoring force of the first urging member 31, thereby disconnecting the fixed contacts 62 from the middle contact 63.

In this embodiment, the flexible arm 83 has a free end that has a curved guiding surface 84 in contact with the driving surface 92 of the blocking plate 9 for tracing along the driving surface 92 toward and away from the flexible contact 61 upon movement of the actuating part 8 in the second direction (Y). The free end of the flexible arm 83 further has a nose 85 protruding therefrom toward the flexible contact 61 for pressing the flexible contact 61 to bend toward the middle contact 63. An insulator sheet 102 is disposed between a bottom side of the actuating part 8 and the flexible contact 61 so as to electrically isolate the flexible arm 83 from the flexible contact 61.

The actuating part 8 further has a supporting frame 86 defining a frame space 87, and an abutting wall 82 extending upwardly from one side of the supporting frame 86. The flexible arm 83 extends from the side of the supporting frame 86 into the frame space 87 in the second direction (Y). The abutting wall 82 is transverse to the flexible arm 83. The operating lever 7 further has an abutting end 72 that is in contact with the abutting wall 82 of the actuating part 8 so as to drive movement of the actuating part 8 in the second direction (Y) when moving in the second direction (Y).

The recessed base 1 is formed with a middle recess 13 and two retaining recesses 136 disposed respectively at two opposite sides of the middle recess 13. The actuating part 8 is received movably in the middle recess 13. The blocking plate 9 includes a base portion 91 formed with an aperture 910 defined by an aperture-defining wall 910', a bent portion 92' extending from the aperture-defining wall 910' into the middle recess 13 and defining the slanted driving surface 92, and two side portions 93 extending from two opposite sides of the base portion 91 into the retaining recesses 136 and formed with retaining holes 930, respectively. Each of the retaining recesses 136 is defined by a recess-defining wall 1361 that is formed with a retaining tongue 135 protruding therefrom into the retaining hole 930 in a respective one of the side portions 93 so as to secure the blocking plate 9 to the recessed base 1.

The recessed base 1 is further formed with a first guiding groove 120 extending in the first direction (X), a retaining groove 111 parallel to the guiding groove 120, and two opposite second guiding grooves 112 extending oppositely from two ends of the retaining groove 111 in the first direction (X) and having a width less than that of the retaining groove 111. The retaining groove 111 is defined by a groove-defining wall. Each of the second guiding grooves 112 is defined by a groove-defining wall. The groove-defining wall of the retaining groove 111 and the groove-defining wall of each of the second guiding grooves 112 cooperatively define a shoulder 113 therebetween. The main plate 54 of the slider 5 covers a top side of the retaining groove 111, and is formed with a bottom groove 541 that cooperates with the retaining groove 111 to define a cylindrical spring-confining space.

In this embodiment, the first switch 4 includes conductive first and second contacts 451, 452 opposite to each other in the first direction (X) and secured to the recessed base 1, a conductive common contact 453 secured to the recessed base 1 and disposed between and spaced apart from the first and second contacts 451, 452, a conductive member 40 connected to the slider 5 and movably received in the first guiding groove 120, and a second urging member 32 received in the spring-confining space defined by the bottom groove 541 and the retaining groove 111 and having two opposite ends abutting against the shoulders 113, respectively. The first and second contacts 451, 452 and the common contact 453 are attached to a wall confining a bottom side of the first guiding groove 120, and are respectively connected to terminals (not shown) embedded in the recessed base 1 for external connection to a circuit (not shown).

Figure 8:
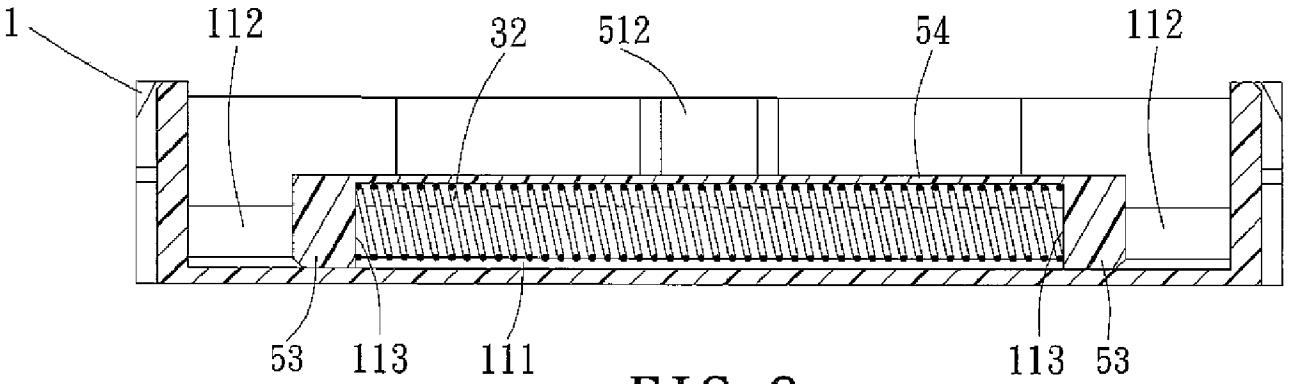
FIG. 8 is a sectional view of the first preferred embodiment to illustrate a state where an urging member is not compressed when a slider is disposed at a normal position.
Figure 9:
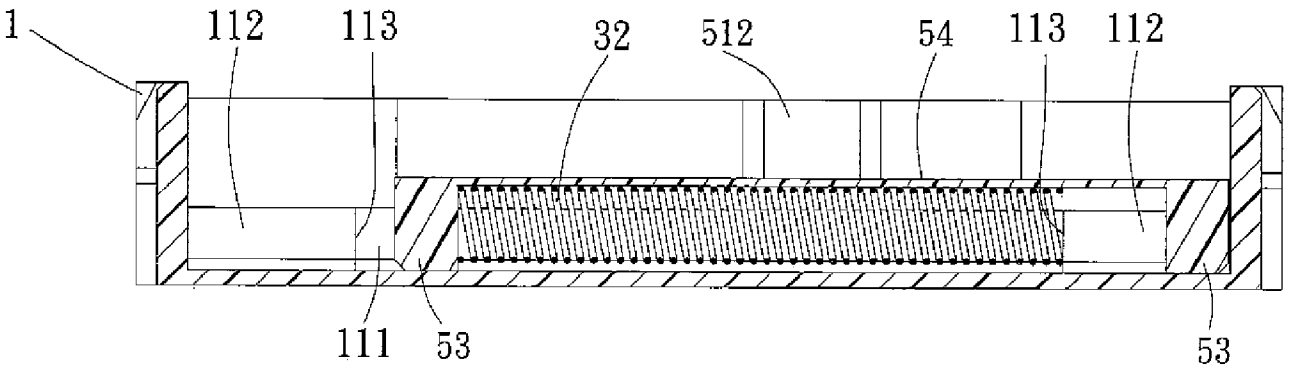
FIG. 9 is a sectional view of the first preferred embodiment to illustrate another state where the urging member is compressed when the slider is disposed at an actuating position.
Figure 11:
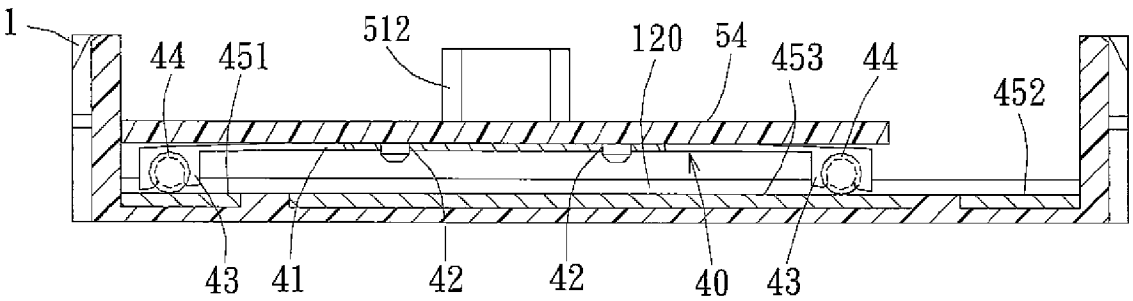
FIG. 11 is a sectional view of the first preferred embodiment to illustrate a state where the slider is disposed at a middle position.

The slider 5 is movable in the first direction (X) between a first position (see FIG. 11) and a middle position (see FIG. 12), and further movable in the first direction (X) between the middle position and a second position (see FIG. 13) opposite to the first position in the first direction (X). The main plate 54 of the slider 5 is further formed with two spring-pushing legs 53 extending therefrom into the second guiding grooves 112, respectively. Each of the spring-pushing legs 53 is moved with the slider 5 from the respective one of the second guiding grooves 112 (see FIG. 8) into the retaining groove 111 (see FIG. 9) so as to push a respective one of the ends of the second urging member 32 toward the other of the ends of the second urging member 32 when the slider 5 is driven by the operating lever 7 to move from the middle position to the first position or the second position, thereby permitting the second urging member 32 to accumulate a restoring force for restoring the slider 5 to the middle position.

Figure 12:
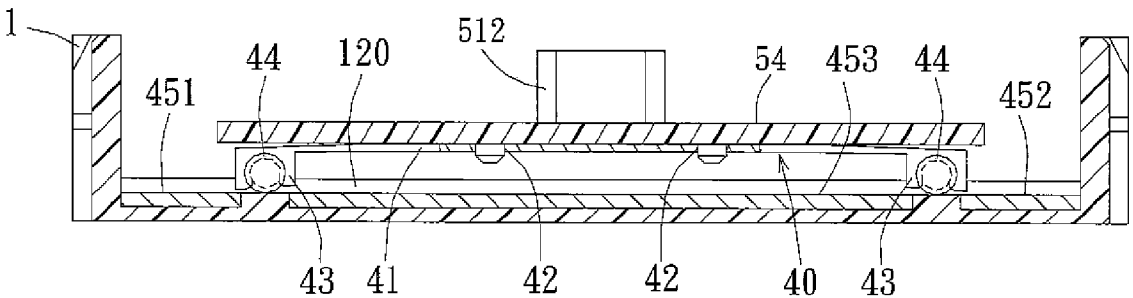
FIG. 12 is a sectional view of the first preferred embodiment to illustrate a state where the slider is disposed at a first position.
Figure 13:
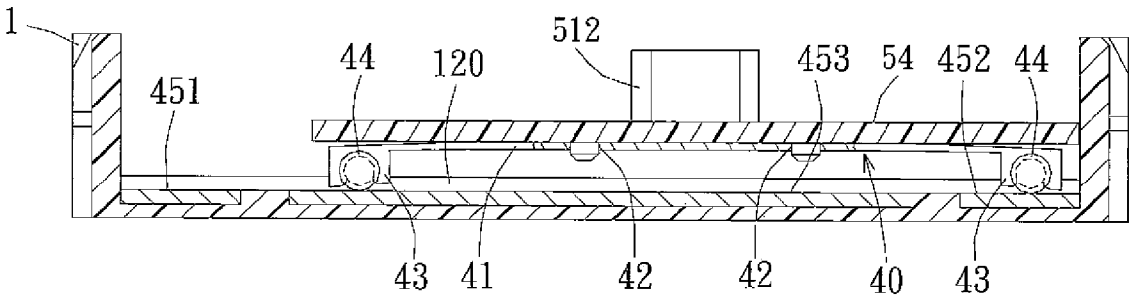
FIG. 13 is a sectional view of the first preferred embodiment to illustrate a state where the slider is disposed at a second position.

The conductive member 40 bridges the first contact 451 and the common contact 453 when the slider 5 is disposed at the first position (see FIG. 11), and is disconnected from the first contact 451 and the common contact 453 when the slider 5 is disposed at the middle position (see FIG. 12). The conductive member 40 bridges the second contact 452 and the common contact 453 when the slider 5 is disposed at the second position (see FIG. 13), and is disconnected from the second contact 452 and the common contact 453 when the slider 5 is disposed at the middle position (see FIG. 12).

In this embodiment, the main plate 54 of the slider 5 is further formed with a pair of inserts 56. The conductive member 40 includes a conductive elongate plate 41 that is slightly resilient and that is formed with a pair of insert holes 42 and a pair of pivot joints 43, and two conductive rollers 44 pivoted to two opposite ends of the conductive elongate plate 41 through the pivot joints 43, respectively. The inserts 56 of the main plate 54 extend fittingly through the insert holes 42 so as to secure the conductive member 40 to the slider 5. The rollers 44 are in contact with the first contact 451 and the common contact 453, respectively, when the slider 5 is disposed at the first position, and are in contact with the second contact 452 and the common contact 453, respectively, when the slider 5 is disposed at the second position.

The base 1 further has two opposite side walls that are formed with engaging projections 16, respectively. The cover 2 includes a cover plate portion 21 covering the top opening 10 of the base 1, and two opposite side tab portions 22 extending from the cover plate portion 21 and formed with engaging holes for extension of the engaging projections 16 therethrough, respectively, so as to secure the cover 2 to the base 1.

Figure 14:
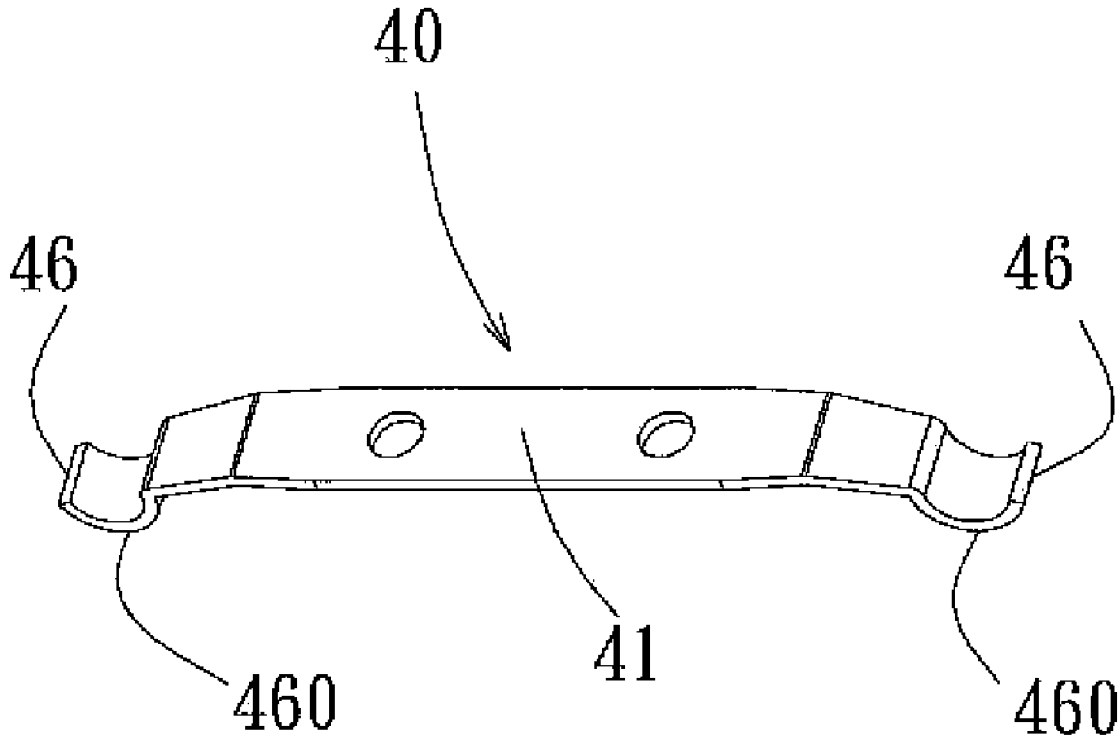
FIG. 14 is a perspective view of a conductive member of a switch of the second preferred embodiment of a multi-directional operating switch assembly according to the present invention.

FIG. 14 illustrates the second preferred embodiment of the multi-directional operating switch assembly according to the present invention. The second preferred embodiment differs from the previous embodiment in that the conductive elongate plate 41 of the conductive member 40 has two opposite bent end portions 46 having round bottom surfaces 460, respectively. With the design of the bent end portions 46 of the elongate plate 41, the conductive rollers 44 employed in the previous embodiment can be dispensed with. The round bottom surfaces 460 of the bent end portions 46 of the elongate plate 41 are in contact with the first contact 451 and the common contact 453, respectively, when the slider 5 is disposed at the first position, and are in contact with the second contact 452 and the common contact 453, respectively, when the slider 5 is disposed at the second position.

By forming the slot 71 in the operating lever 7 for extension of the protrusion 512 of the slider 5 therethrough and by disposing the first urging member 31 in the slot 71 to abut against the protrusion 512 and the operating lever 7 for restoring the operating lever 7 of the multi-directional operating switch assembly to its original position, at least the aforesaid size problem associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A multi-directional operating switch assembly comprising:

a recessed base;

a first switch disposed in said recessed base;

a second switch disposed in said recessed base;

a slider disposed slidably in said recessed base and having a main part and a protrusion protruding from said main part, said slider being slidable relative to said recessed base in a first direction so as to actuate said first switch;

an operating lever having a slot defined by a slot-defining wall, said protrusion of said slider extending into said slot, said operating lever being movably supported on said main part of said slider, being movable relative to said recessed base in the first direction to drive said slider to move in the first direction, and being further movable relative to said slider in a second direction to actuate said second switch, said first and second directions crossing each other; and a first urging member disposed in said slot and abutting against said protrusion of said slider and said slot-defining wall such that said first urging member accumulates a restoring force when said operating lever is moved in the second direction to actuate said second switch.

2. The multi-directional operating switch assembly of claim 1, wherein said second switch includes two opposite conductive fixed contacts secured to said recessed base, a conductive middle contact secured to said recessed base and disposed between said fixed contacts, a conductive flexible contact in constant contact with said fixed contacts and flexible to bend toward and away from said middle contact, a blocking plate secured to said recessed base and having a slanted driving surface slanted relative to the second direction, and an actuating part mounted movably in said recessed base and having a flexible arm, said operating lever being movable in the second direction relative to said slider to drive said actuating part to move in the second direction, said driving surface of said blocking plate being configured to bend said flexible arm such that said flexible arm is bent to trace along said driving surface toward said flexible contact when said actuating part is driven by said operating lever to move in the second direction, said flexible arm being configured to bend said flexible contact toward said middle contact such that said flexible contact is brought into contact with said middle contact when said flexible arm is bent by said driving surface upon movement of said actuating part in the second direction.

3. The multi-directional operating switch assembly of claim 2, wherein said flexible arm has a free end that has a curved guiding surface in contact with said driving surface of said blocking plate for tracing along said driving surface toward said flexible contact, said free end of said flexible arm further having a nose protruding therefrom toward said flexible contact for pressing said flexible contact to bend toward said middle contact.

4. The multi-directional operating switch assembly of claim 3, further comprising an insulator sheet disposed between a bottom side of said actuating part and said flexible contact so as to electrically isolate said flexible arm from said flexible contact.

5. The multi-directional operating switch assembly of claim 2, wherein said actuating part further has a supporting frame defining a frame space, and an abutting wall extending from one side of said supporting frame, said flexible arm extending from said side of said supporting frame into said frame space in the second direction, said abutting wall being transverse to said flexible arm, said operating lever further having an abutting end that is in contact with said abutting wall of said actuating part so as to drive movement of said actuating part in the second direction.

6. The multi-directional operating switch assembly of claim 2, wherein said recessed base is formed with a middle recess and two retaining recesses disposed respectively at two opposite sides of said middle recess, said actuating part being received movably in said middle recess, said blocking plate including a base portion formed with an aperture defined by an aperture-defining wall, a bent portion extending from said aperture-defining wall into said middle recess and defining said slanted driving surface, and two side portions extending from two opposite sides of said base portion into said retaining recesses and formed with retaining holes, respectively, each of said retaining recesses being defined by a recess-defining wall that is formed with a retaining tongue protruding therefrom into said retaining hole in a respective one of said side portions so as to secure said blocking plate to said recessed base.

7. The multi-directional operating switch assembly of claim 1, wherein said first switch includes a conductive first contact secured to said recessed base, a conductive common contact secured to said recessed base and spaced apart from said first contact, and a conductive member connected to said slider, said slider being movable in the first direction at least between a first position and a middle position, said conductive member bridging said first contact and said common contact when said slider is disposed at the first position, and being disconnected from said first contact when said slider is disposed at the middle position.

8. The multi-directional operating switch assembly of claim 7, wherein said first switch further includes a conductive second contact secured to said recessed base, opposite to said first contact in the first direction, and spaced apart from said common contact, said common contact being disposed between said first and second contacts, said slider being further movable between the middle position and a second position, said conductive member bridging said second contact and said common contact when said slider is disposed at the second position, and being disconnected from said second contact when said slider is disposed at the middle position.

9. The multi-directional operating switch assembly of claim 8, wherein said conductive member includes a conductive elongate plate and two conductive rollers pivoted to two opposite ends of said conductive elongate plate, respectively, said rollers being in contact with said first contact and said common contact, respectively, when said slider is disposed at the first position, and being in contact with said second contact and said common contact, respectively, when said slider is disposed at the second position.

10. The multi-directional operating switch assembly of claim 7, wherein said recessed base is formed with a guiding groove extending in the first direction, said conductive member being movably received in said guiding groove.

11. The multi-directional operating switch assembly of claim 10, further comprising a second urging member, said recessed base being further formed with a retaining groove parallel to said guiding groove, said main plate covering a top side of said retaining groove and being formed with a bottom groove that cooperates with said retaining groove to define a spring-confining space, said second urging member being received in said spring-confining space, said main plate being further formed with two spring-pushing legs extending therefrom into said spring-confining space and abutting against two opposite ends of said second urging member.

12. The multi-directional operating switch assembly of claim 7, wherein said conductive member includes a conductive elongate plate that has two opposite bent end portions having round surfaces, respectively, said round surfaces of said bent end portions of said elongate plate being in contact with said first contact and said common contact, respectively, when said slider is disposed at the first position.

* * * * *